US006152209A

United States Patent [19]

Pleschiutschnigg

[11] Patent Number: 6,152,209

[45] Date of Patent: Nov. 28, 2000

[54] METHOD AND DEVICE FOR MEASURING AND REGULATING THE TEMPERATURE AND QUANTITY OF COOLING WATER FOR WATER-COOLABLE WALLS OF A CONTINUOUS CASTING MOLD

[75] Inventor: Fritz-Peter Pleschiutschnigg, Duisburg, Germany

[73] Assignee: SMS Schloemann-Siemag Aktiengesellschaft, Düsseldorf, Germany

[21] Appl. No.: 09/082,884

[22] Filed: May 21, 1998

[30] Foreign Application Priority Data

May 31, 1997 [DE] Germany ..... 197 22 877

[51] Int. Cl.[7] ..... B22D 11/22

[52] U.S. Cl. ..... 164/455; 164/414

[58] Field of Search ..... 164/455, 485, 164/151.4, 151.5, 414, 154.6, 154.7, 155.6

[56] References Cited

U.S. PATENT DOCUMENTS

| | | | |
|---|---|---|---|
| 3,923,091 | 12/1975 | Dorr et al. | 164/414 |
| 3,926,244 | 12/1975 | Meier et al. | 164/455 |
| 3,995,490 | 12/1976 | Canalini et al. | 164/455 |
| 4,949,777 | 8/1990 | Itoyama et al. | 164/151.5 |

FOREIGN PATENT DOCUMENTS

| | | | |
|---|---|---|---|
| 2415224 | 10/1974 | Germany . | |
| 4117073 | 3/1993 | Germany . | |
| 195 29 931 | 4/1997 | Germany . | |
| 56-53853 | 5/1981 | Japan | 164/455 |
| 2-151356 | 6/1990 | Japan | 164/151.4 |
| 2-179344 | 7/1990 | Japan | 164/485 |

*Primary Examiner*—Kuang Y. Lin
*Attorney, Agent, or Firm*—Friedrich Kueffner

[57] ABSTRACT

A method and a device for measuring and regulating the temperature and quantity of cooling water of a continuous casting mold which flows per unit of time through mold walls composed of copper plates which can be cooled by water, particularly independently of each other, wherein the cooling water temperature of a mold wall is measured at least at two locations in the areas of the outlet openings of a copper plate and the corresponding water box, a temperature profile is prepared from the values measured over the width of the copper plate, and the temperature profiles obtained in time intervals are compared to each other. Temperature sensors are arranged in the water discharge area between a copper plate and the cooling water outlet openings of the water box especially on each long side plate at least at two locations thereof, and the signal lines of the temperature sensors are connected to a computer, preferably with an on-line screen.

14 Claims, 3 Drawing Sheets

FIG.2
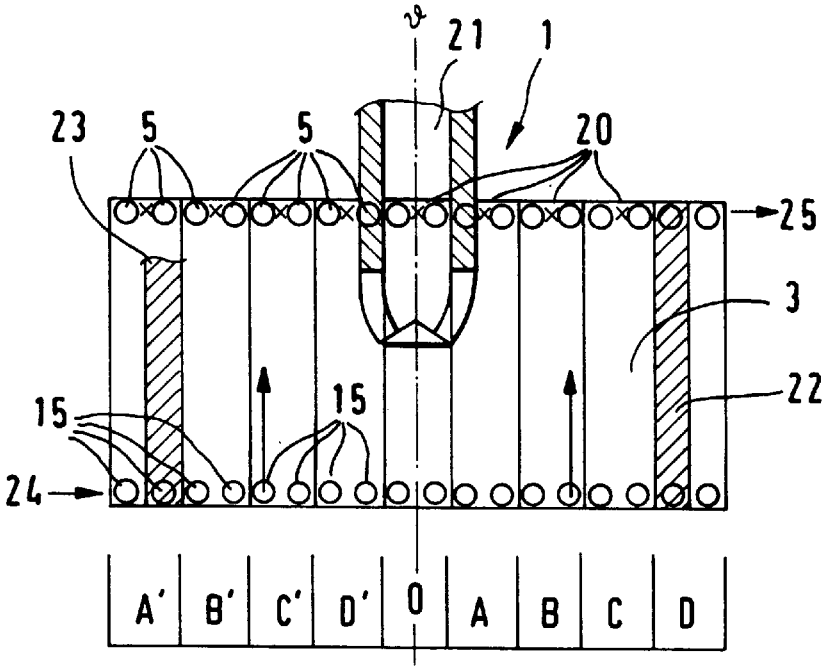
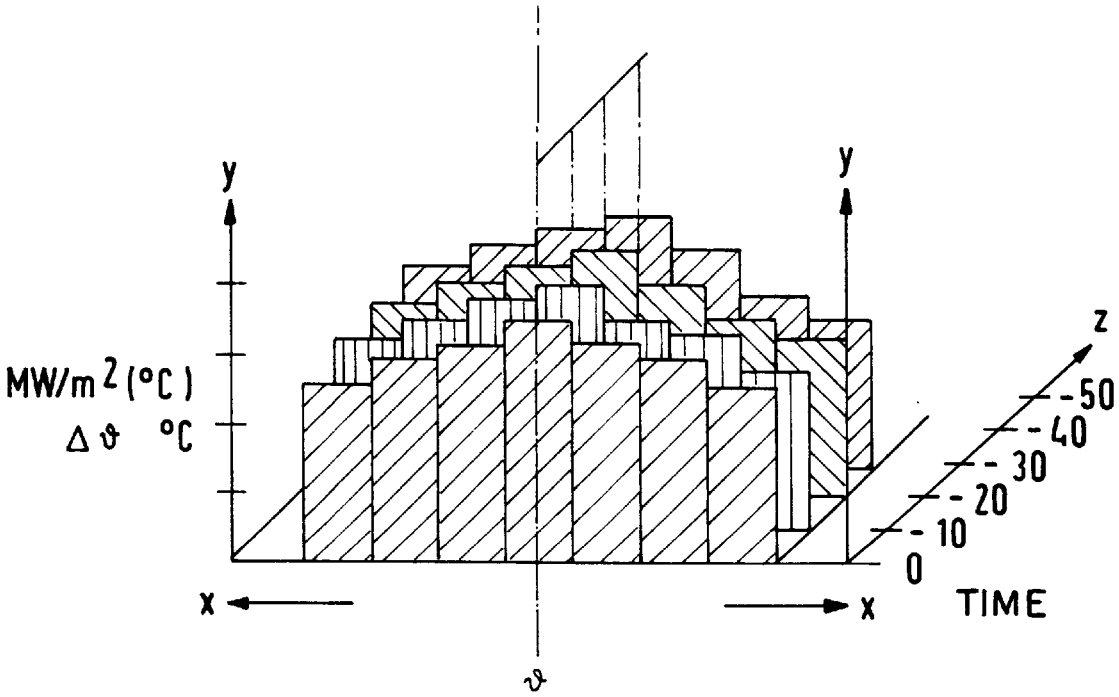
FIG. 3

METHOD AND DEVICE FOR MEASURING AND REGULATING THE TEMPERATURE AND QUANTITY OF COOLING WATER FOR WATER-COOLABLE WALLS OF A CONTINUOUS CASTING MOLD

BACKGROUND OF THE INVENTION

1. Field of the Invention

The present invention relates to a method of measuring and regulating the temperature and quantity of cooling water of a continuous casting mold which flows per unit of time through mold walls composed of copper plates which can be cooled by water, particularly independently of each other.

The present invention also relates to a device for carrying out the method.

2. Description of the Related Art

When continuously casting steel in liquid-cooled plate molds, particularly for producing thin slabs of steel with strand thicknesses of between 150 and 40 mm at comparatively high casting speeds with the use of at least one submerged pouring pipe, initially only a thin strand shell composed of solidified melt and still relatively resilient because of the very high temperature is formed within the mold in the area of the mold outlet opening due to the relatively low thermal conductivity of the steel. Since the strand shell must withstand within the mold and after emerging from the mold the ferrostatic pressure of the melt which is still liquid in the interior, it is necessary that the strand shell has as uniform as possibly a thickness over the entire circumference. The formation of the strand shell depends on a number of interacting factors, such as, casting speed, steel temperature, material, strand geometry, submerged outlet shape, conicality of the mold as well as the type and composition of the slag-forming lubricant which is applied on the meniscus and has the purpose of reducing the unavoidable friction between the strand shell and the mold.

Particularly important in this connection is a uniform distribution of the lubricant in the areas of the mold walls, wherein the lubricant is applied on the meniscus in the form of a so-called casting powder, the lubricant is melted and is moved as a result of oscillating movements of the liquid steel between the steel and the mold walls. A distribution of the lubricant as uniform as possible between the forming strand shell and the mold wall is of particular importance with respect to the heat transfer conditions between the strand shell and the mold wall. By carrying out careful temperature measurements in the areas of the mold walls, conclusions can be made with respect to the distribution of the heat fluxes, particularly over the width of the mold. This is important because, for a safe casting of slabs and especially thin slabs of the above-mentioned type, the knowledge of specific heat transfers at the long sides of the mold and especially in the middle of the slab in the area of the submerged pouring pipe is of particular significance. This makes it possible to prevent or counteract problems in time, wherein these problems may be due, for example, to flow anomalies occurring at the pouring outlet, non-uniform thickness of the lubricating film of casting slag, high membrane effect of the strand shell particularly in the slab middle, turbulences of the meniscus over the width of the slab. Also, it is possible to timely recognize by a temperature measurement the consequences of a non-uniform heat transfer due, for example, to turbulences of the steel in the mold. This is particularly important because the aforementioned anomalies in the casting process, particularly a possible deviation of the strand shell formation from the mold middle, may result in longitudinal cracks in the strand surface and even in ruptures, or so-called stickers. Simultaneously with such problems at the strand shell, corresponding partial thermal loads occur at the copper plates which may lead to a reduction of the service life of the mold.

A number of embodiments and measures for ensuring a safe continuous casting process without the aforementioned disadvantages and difficulties are known in the art. For example, DE 24 15 224 C3 discloses a plate mold for slabs whose walls have cooling chambers which each have defined cooling zones. Connected to the inlet and outlet lines for the cooling water of the long side walls of the mold are measuring units for determining the discharged heat quantity or the cooling capacities. By using these measuring units, an average value of the cooling capacity of the cooling chambers is computed and the average value is supplied to an averaging unit which controls the conicality of the short sides of the mold.

DE 41 17 073 C2 discloses a method of determining the integral and specific heat transport at each individual copper plate of a rectangular or cambered thin slab mold by using calorimetric measurements. A regulation of the short side conicality independently of the individually selected casting parameters is made possible by an on-line comparison of the specific heat fluxes from the copper plate side facing the steel to the water-cooled side specifically of the short sides with those of the long sides.

This method has the disadvantage that with respect to the aforementioned molds no differentiated statements are made with respect to the partial heat fluxes along the mold width. This is also particularly disadvantageous because no determination is made of differentiated specific heat transfers in the areas of the long side walls and especially in the slab middle in the area of the submerged pouring pipe which would produce safe casting of slabs and especially of thin slabs at comparatively high casting speeds. Only when these specific heat transfers are known is it possible to achieve a regulation of the heat fluxes over the entire long side of the mold and thus, over the entire slab width in order to prevent problems especially due to a non-uniform formation of the strand shell.

In order to provide particularly favorable conditions for the casting of thin slabs, a plate mold is known in the art which has water-cooled short side walls which can be clamped between the long side walls, wherein the mold includes devices for adjusting the shape-imparting hollow space to various strand dimensions and for the casting cone, and with an oscillating device. In this mold, the long side walls have at least three cooling segments which are located next to each other and are independent of each other, wherein these cooling segments are distributed symmetrically relative to the middle axis and have in the area of the mold outlet opening special connections for the independent supply of a liquid cooling medium. Temperature sensors are provided in the wall portions of the chambers facing the strand, wherein the temperature sensors are capable of determining at least the temperature differences between the individual chambers or zones.

This division into separate chambers or zones does have the disadvantage that substantially different temperature flows may form on both sides of the separating webs of adjacent chambers or zones, wherein these temperature flows can only be equalized with a relatively long time delay. The known configuration of the cooling segments is not capable in a satisfactory manner to provide a sensitive determination of partial heat fluxes or heat flux differences, for example, over the total width of a mold side wall.

SUMMARY OF THE INVENTION

Therefore, it is the primary object of the present invention to provide a method and a device of the above-described type which are capable as much as possible without time delay of determining the heat fluxes occurring in the interior of the mold in the melt by means of sensitive differentiated measurements of the corresponding heat fluxes of the cooling water flowing through the mold walls, in order to derive from this determination in a timely fashion regulating pulses for regulating out undesirable heat exchange conditions, particularly with respect to the formation of the strand shell in the areas of the mold walls.

In accordance with the present invention, in a method of the above-described type for measuring and regulating the cooling water temperature and quantity, the cooling water temperature of a mold wall is measured at least at two locations in the areas of the outlet openings of a copper plate and the corresponding water box, a temperature profile is prepared from the values measured over the width of the copper plate, and the temperature profiles obtained in time intervals are compared to each other. The inlet temperature of the cooling water is measured and the difference between the inlet and outlet temperatures is determined. From the cooling water quantity per unit of time a partial or integral heat discharge from at least a mold wall portion is determined and partial deviations are compensated by partial quantity corrections of the cooling water.

The method according to the present invention makes it possible to obtain a differentiated statement concerning the distribution of partial heat fluxes along the mold width and, thus, to carry out a simple and safe temperature guidance of the heat fluxes of the melt within the mold near the mold walls and in the middle of the long side walls in the area of the submerged pouring pipe or pouring outlet.

Simultaneously, the method makes it possible to adjust an extremely sensitive and uniform cooling capacity along the width of a mold and especially in the area of the submerged pouring outlet in comparison to the remaining surface areas of the long side walls and to the short side walls, and thus, to prevent problems which could be caused, for example, by turbulent flows due to the submerged pouring outlet, by a non-uniform lubricating film thickness, by a high membrane effect of the strand shell in the slab middle, and by turbulences of the meniscus over the width of the slab.

In accordance with a very important further development of the method according to the present invention, the partial or integral heat fluxes of the cooling water or the melt over the width of the mold are made visible on an on-line screen, preferably in the form of temperature profiles. This measure makes it possible for the operator of the continuous casting plant to have a direct overview over the various heat fluxes and particularly the changes of the heat fluxes over time, so that measures can be taken immediately when problems are seen. In addition, limit values can be prepared which can be utilized for the prevention of ruptures.

In a liquid-cooled plate mold for carrying out the method described above, temperature sensors are arranged in the water discharge area between a copper plate and the cooling water outlet openings of the water box especially on each long side plate at least at two locations thereof, and the signal lines of the temperature sensors are connected to a computer, preferably with an on-line screen.

In accordance with a preferred embodiment, the water outlet openings between the copper plate and the water box are arranged uniformly distributed over the mold width and are each configured for the passage of a constant, equal water quantity.

The method and the device according to the present invention can be used for the production of thin slabs of steel with strand thicknesses of between preferably 40 and 150 mm at comparatively high casting speeds as well as for billet molds for continuously casting rectangular or round continuously cast sections.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 2 is a side view, partially in section, of a long mold side wall with the arrangement of cooling water temperature measuring devices in the area of the water inlet as well as in the area of the water outlet; and FIG. 3 is a diagram showing several temperature profiles along a long side of a mold in comparison with temperature profiles obtained over time intervals.

DESCRIPTION OF THE PREFERRED EMBODIMENTS

Figure 1:
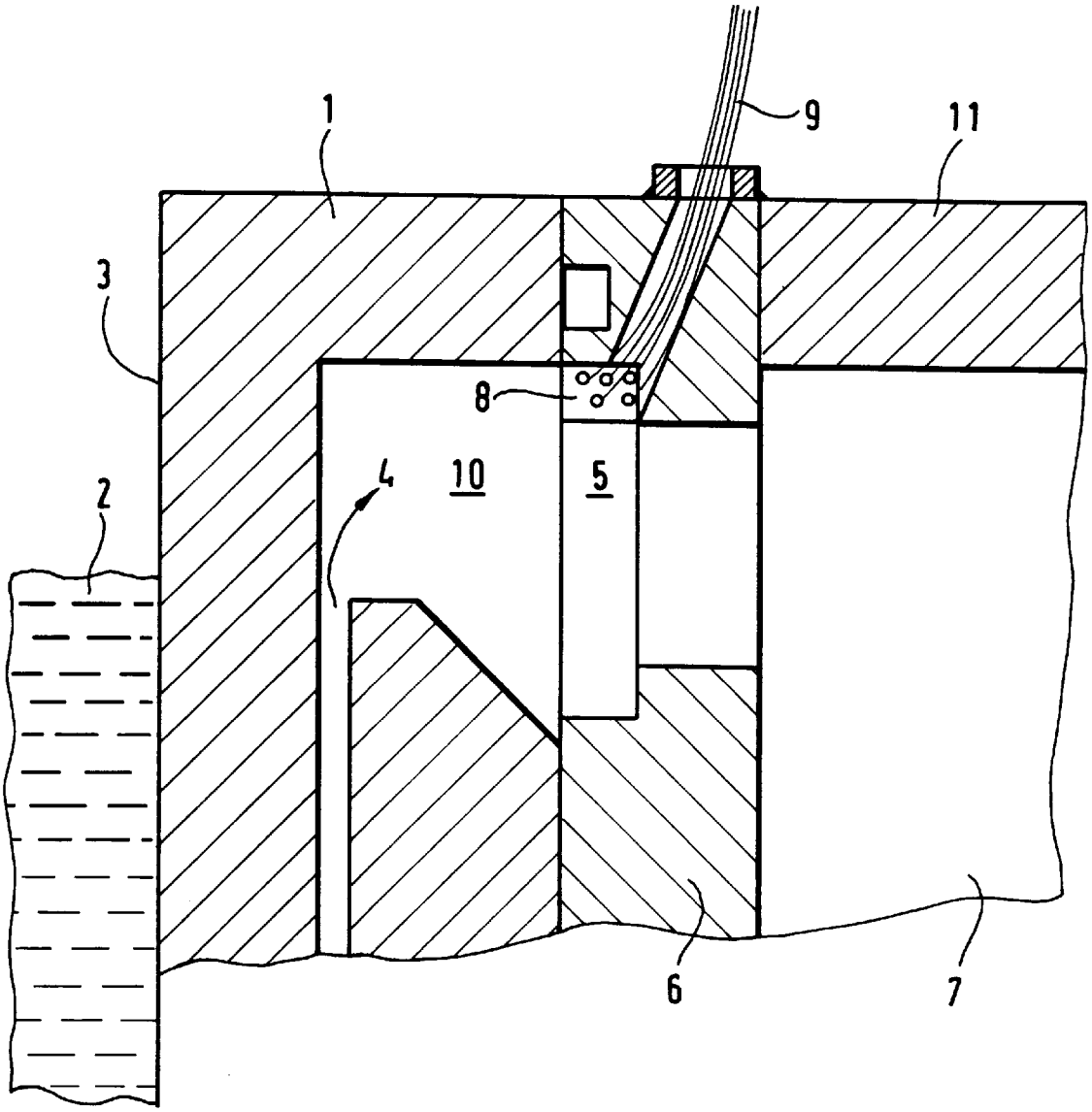
FIG. 1 is a sectional view of the outlet portion of a long mold side wall with corresponding water box and arrangement of a thermocouple with heat sensors.

FIG. 1 of the drawing shows a long mold side wall 1 composed of copper with a surface portion 3 facing the metal melt bath 2. In the solid wall of copper, cooling agent bores 4 are arranged in a close sequence, wherein cooling water flows in a forced manner from the bottom toward the top through the bores 4. The bores 4 end at the upper side in a collecting duct 10 which leads through bores 5 into a water box 7. The water box 7 is composed of plate-shaped elements 6 and 11.

Figure 1A:
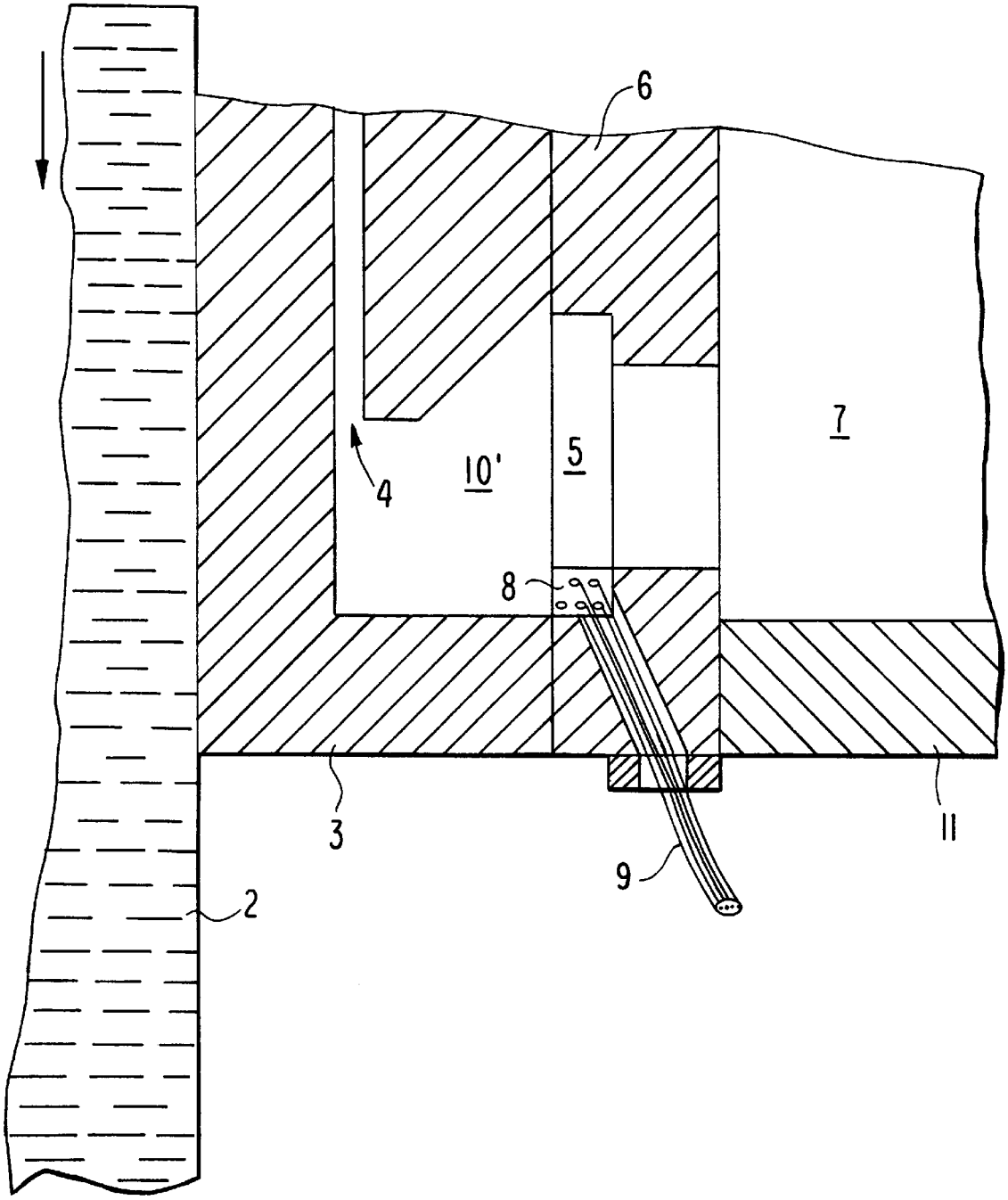
FIG. 1*a* is a sectional view of the inlet portion of a long mold side wall with corresponding water box and arrangement of a thermocouple with heat sensors.

FIG. 1*a* shows the inlet side of the long mold side wall. The cooling water flows from the water box 7 through the lower collecting duct 10' into the bores 4.

Arranged in the area of the connecting bore 5 is a thermocouple 8 in the form of a longitudinal web of copper with ducts for receiving signal lines 9 leading to the individual heat sensors 20, shown in FIG. 2. The sensors 20 are arranged symmetrically relative to the center axis of each long side of the mold. The thermocouple may be, for example, an independent structural group which includes the individual heat sensors 20 with their signal lines 9. The thermocouple may be attached in the corner area of the wall portion 6 in such a way that at least two surfaces of the thermocouple are in the flow area of the cooling liquid. Also, for each measuring location, a bore may be provided through the water box in the upper area thereof, wherein a measuring sensor can then be inserted from the outside in this bore.

FIG. 2 of the drawing shows the surface portion 3 of a plate mold provided, in accordance with the present invention, with a plurality of cooling water outlet bores 5 in the upper portion of the long side wall 1, shown in horizontal projection, on both sides of the submerged pouring pipe 21. Provided for the inlet of cooling water are in the lower area of the long side wall 1 a plurality of inlet bores 15 arranged closely next to each other and each in a vertical plane with the outlet bores 5, wherein the inlet bores 5 are also arranged on both sides of the center plane v—v of the mold wall. The bores 15 interact to produce the water inlet 24 of the cooling water flow into the cooling duct 4 of the mold 1, while the sum of the outlet bores 5 together form the water outlet 25. Arranged to the right and left of the center plane v—v are the short side walls 22 and 23 forming the lateral ends of the long side wall 1. The heat sensor 20 is installed always between two water outlet bores 5. Always two water outlet bores 5 arranged next to each other form together with two water inlet bores 15 arranged in the same vertical plane a flow field A, B, C, D or A', B', C', D'.

FIG. 3 is a three-dimensional diagram showing temperature profiles each measured over the width A' to D of a slab mold plate with, for example, four temperature profiles which are to be compared with each other and are spaced apart from each other with respect to time intervals of ten time units each along the time axis z. The width of the mold plate is plotted on the abscissa x—x and the value of the measured heat transport is plotted on the ordinate y. The representation corresponds, for example, to a diagram on the screen of the computer and makes possible an immediate evaluation and regulation in the event a deviation from a predetermined temperature profile occurs.

While specific embodiments of the invention have been shown and described in detail to illustrate the inventive principles, it will be understood that the invention may be embodied otherwise without departing from such principles.

I claim:

1. A method of measuring and regulating temperature and quantity of cooling water of a continuous casting mold flowing per unit of time through water-coolable mold walls composed of copper plates wherein cooling water inlet bores together form a water inlet in cooling ducts of the mold wall, while a sum of discharge bores of the cooling ducts together form a water discharge, the method comprising measuring a cooling water temperature of a mold wall at at least two locations in an area of outlet openings of the mold wall and a corresponding water box, measuring an inlet temperature of the cooling water, determining a difference between inlet and outlet temperature, determining from the cooling water quantity per unit of time a partial and integral heat discharge from at least a mold wall portion, preparing a temperature profile over the width of the mold wall, comparing temperature profiles obtained in time intervals with each other and compensating partial deviations by partial quantity corrections of the cooling water.

2. The method according to claim 1, wherein the mold walls are water-coolable independently of each other.

3. The method according to claim 1, comprising arranging cooling water outlet openings uniformly over a width of a mold wall, and carrying out a temperature measurement between two adjacent outlet openings.

4. The method according to claim 3, wherein the cooling water outlet openings are uniformly arranged in the long side walls of the mold.

5. The method according to claim 4, comprising carrying out the temperature measurements at locations of the long side wall which are symmetrical relative to a center axis of the mold.

6. The method according to claim 1, comprising making visible the partial or integral heat fluxes of the cooling water or the melt over the width of the mold on an on-line screen in the form of temperature profiles.

7. Liquid-cooled mold comprising long side walls and short side walls in the form of copper plates, at least the long side walls having bores for conducting cooling water therethrough, wherein in a lower portion of each long side wall is arranged a water inlet and in an upper portion of each long side wall is arranged a water discharge for the cooling water, wherein cooling ducts with inlet bores and discharge bores are arranged in each long side wall closely next to each other and in a vertical plane, wherein the inlet bores form the water inlet of the cooling water into the mold wall and a sum of the discharge bores together form the water discharge, comprising in each of the cooling water inlet bores at least one temperature sensor having a first signal line and a sensor for the admitted quantity per unit of time having a second signal line, further comprising temperature sensors at at least two locations of the water discharge between a side wall and each of the cooling water outlet openings of a water box having signal lines, wherein said first and second signal lines are connected together with the signal lines of the temperature sensors of the water outlet area to a computer.

8. The mold according to claim 7, wherein the computer comprises an on-line screen.

9. The mold according to claim 7, wherein in an area of at least every second outlet opening is arranged a thermocouple containing a temperature sensor.

10. The mold according to claim 7, wherein at least in an area of every second outlet opening is arranged a thermocouple containing a temperature sensor, and wherein for each temperature sensor a bore is arranged in the water box in an area of the outlet opening, such that a temperature sensor can be inserted from outside in the bore.

11. The mold according to claim 7, wherein temperature sensors are arranged symmetrically relative to a center axis of each long side of the mold.

12. The mold according to claim 7, wherein cooling water outlet openings are distributed uniformly over the width of the long side walls of the mold and a temperature sensor is installed always between two outlet openings.

13. The mold according to claim 7, wherein the computer is connected on-line to a screen.

14. The mold according to claim 7, wherein the water outlet openings are uniformly distributed between the mold wall and water box over the width of the mold, and wherein each water outlet opening is configured for a passage of a constant, equal water quantity.

* * * * *